US005494417A

United States Patent [19]

Davis et al.

[11] Patent Number: 5,494,417

[45] Date of Patent: Feb. 27, 1996

[54] SHAFT SEALING AND ALIGNMENT ASSEMBLY FOR A PUMP ASSEMBLY

[75] Inventors: Lee W. Davis, Oklahoma City; Randy W. Karbs, Edmond; Ron L. Baumgarner, Oklahoma City, all of Okla.

[73] Assignee: Little Giant Pump Company, Oklahoma City, Okla.

[21] Appl. No.: 285,352

[22] Filed: Aug. 3, 1994

[51] Int. Cl.[6] ..... F04B 35/04

[52] U.S. Cl. ..... 417/423.11; 417/423.15; 417/423.14; 415/230; 415/213.1

[58] Field of Search ..... 417/423.9, 423.11, 417/423.14, 423.15, 902; 415/213.1, 214.1, 230, 231

[56] References Cited

U.S. PATENT DOCUMENTS

| | | | |
|---|---|---|---|
| 3,186,187 | 6/1965 | Embury et al. | 417/902 |
| 3,301,191 | 1/1967 | Warren | 415/231 |
| 3,969,043 | 7/1976 | Bright et al. . | |
| 4,135,863 | 1/1979 | Davis et al. . | |
| 4,421,456 | 12/1983 | Huffmam | 415/231 |
| 4,605,235 | 8/1986 | Sundberg et al. . | |
| 4,667,736 | 5/1987 | Rumbaugh et al. . | |
| 4,667,737 | 5/1987 | Shaw et al. . | |
| 5,180,297 | 1/1993 | Hansen et al. . | |

*Primary Examiner*—Charles Freay
*Attorney, Agent, or Firm*—Bill D. McCarthy

[57] ABSTRACT

An improved pump assembly having a housing assembly, a motor assembly and a pump, the housing assembly having a motor mounting plate supporting the motor assembly and the pump. The motor assembly has a motor with a rotatable shaft extending through a shaft aperture in the motor mounting plate to operatively connect to an impeller of the pump. The motor assembly includes a shaft sealing and alignment assembly which provides precise alignment and sealing of the rotatable shaft by a shaft seal mount and a shaft seal disposed in a precisely configured shaft seal bore therein. The shaft seal mount attaches to the motor and has its distal end disposed in the shaft aperture of the motor mounting plate.

14 Claims, 2 Drawing Sheets

SHAFT SEALING AND ALIGNMENT ASSEMBLY FOR A PUMP ASSEMBLY

BACKGROUND OF THE INVENTION

1. Field of the Invention

The present invention relates generally to improvements in the construction of pump assemblies, and more particularly but not by way of limitation, to improvements in shaft to shaft seal alignment in such pumps assemblies.

2. Discussion

Potted pump assemblies are used extensively in this country and abroad in various fluid transfer applications. Potted pump assemblies are generally classified as a type having a motor contained within a hermetically sealed housing for separation from the environment in which the pump assembly must operate. Potted pump assemblies are commonly powered by an electrical motor which drives a pump. It is necessary to provide sealing integrity in the location where the rotatable shaft of the motor extends from the housing to engage and operate the externally mounted pump.

A potted pump assembly is used whenever it is necessary to provide a separating seal between the motor and the environment in which the pump assembly operates. One example is a pump assembly operating in an explosive environment, where it is necessary to prevent the exposure of electrical arcing to the environment. Further applications for a potted pump assembly are in a clean room environments, and in food processing environments, where it is necessary to prevent exposure of contamination such as oil within the motor housing from entering the environment.

One type of potted pump assembly is a submersible pump assembly, which operates while submersed in the fluid being pumped. Submersible pump assemblies must meet various industrial and household needs. A common industrial use is in coolant or lubrication fluid transfer in manufacturing or processing equipment. Common household uses find submersible pump assemblies used in removing unwanted water, as in basement flooding; submersible pump assemblies are also widely used in decorative fountains and water gardens.

This market for potted pump assemblies demands the manufacture of a relatively lightweight and inexpensive pump assembly that is reasonably efficient to operate. Furthermore, in a consumer market, pleasant styling along with an attractive and durable color finish are often what appeal to the customer. These product feature requirements have lead to the manufacture of these pump assemblies from primarily plastic components. Plastic mold injected parts provide a less expensive design, and plastic part construction makes it possible for many secondary operations, such as drilling and tapping of holes, to be completely eliminated. This reduces both assembly labor costs, and operational burden costs. Plastic parts made with pigmented raw material provide superior color and gloss retention reliability as compared to painted parts. Painting, too, requires secondary operations resulting in a more expensive design. Another advantage to plastic construction is the corrosion resistance superiority of plastics as compared to metals.

Parts made by the plastic mold injection process present certain challenges, however, in the design and assembly of pump components. Warpage and draft are common characteristics of plastic mold injected parts, contributing to component part to part variation. Design tolerances in some functionally critical mating parts, as in the motor shaft to the shaft seal, require precise parts with minimal variation to prevent secondary fitting operations. Correct alignment of the shaft to the shaft seal is dependent on precise positioning of the motor relative to the shaft seal bore.

Misalignment of the motor to the shaft seal bore presents difficult assembly problems. It is not unusual for the standard assembly procedure to consist of trained assemblers performing hand fit functions such as trimming, shaving, press fitting, and striking the components to hand fit and force the components. This results in the need for a relatively high degree of craftsmanship by the assemblers, resulting in difficult challenges in managing the acceptable job skills necessary to properly assemble a pump. Individually modified and hand fitted parts also results in the production of pumps lacking consistent operating performance. The described assembly procedure is an expensive way to operate, and is likely to produce unreliable pumps with unpredictable operating performance.

Misalignment of the motor shaft to the shaft seal can result in premature wear of either the motor shaft or the shaft seal. Excessive wear can lead to fluid leakage past the shaft seal, resulting in motor failure or an environmental risk. Misalignment of the motor shaft to the shaft seal can also result in excessive frictional forces, which can produce heat buildup at a rate faster than that which can be dissipated. This excessive heat can also shorten the life of the motor.

Fluid leakage past the shaft seal into the motor housing can also present a safety hazard. Liquids in contact with electrically live connections can conduct voltage which could produce a catastrophic safety danger to a person in contact with the liquid. Remedies to minimize the risk of this occurrence are well known in the art, and include the use of ground fault circuitry, and double insulation techniques. Nevertheless, there is a need in the industry for a pump with a more reliable shaft seal assembly construction, to prevent the described reliability problems and associated safety risks.

SUMMARY OF THE INVENTION

The present invention provides an improved pump assembly having a housing assembly which includes a motor housing attached to a motor mounting plate hermetically sealed once a motor assembly is disposed within the housing assembly. The motor assembly has a motor with a rotatable shaft which extends coaxially through a seal bore aperture in the motor mounting plate, and a shaft sealing and alignment assembly serves to align and seal about the rotatable shaft.

The shaft sealing and alignment assembly includes a shaft seal mount which attaches to the motor at one end thereof and which has the distal end thereof press fit into the seal bore aperture of the motor mounting plate. The shaft seal mount provides a shaft seal bore which is precisely disposed so that the rotatable shaft of the motor extends coaxially therethrough, and a shaft seal is supported within the shaft seal mount to seal about the rotatable shaft, thereby axially aligning the shaft seal and the rotatable shaft.

A pump is supported on the motor mounting plate so that an impeller thereof is operatively engaged by the distal end of the rotatable shaft of the motor.

An object of the present invention is to provide a potted pump assembly with superior shaft seal performance.

A further object of the present invention, while achieving the above described object, is to provide a more reliable potted pump assembly with superior operating characteristics.

Another object of the present invention, while achieving the above described objects, is to provide a potted pump assembly with consistently predictable operating performance.

A further object of the present invention, while achieving the above described objects, is to provide a potted pump assembly that requires minimal time and skill to assemble, while having precision operating characteristics especially in the parts associated with the critical attribute of shaft to shaft seal alignment and concentricity Another object of the present invention, while achieving the above stated objects, is to provide a potted pump assembly requiring little or no secondary operations to manufacture and assemble.

A further object of the present invention, while achieving the above stated objects, is to provide a pump assembly that is inexpensive to manufacture and assemble, yet which provides superior operating performance and efficiency with minimal maintenance.

Other objects, features and advantages of the present invention will be apparent from the following detailed description when read in conjunction with the accompanying drawings and appended claims.

DESCRIPTION

Figure 1:
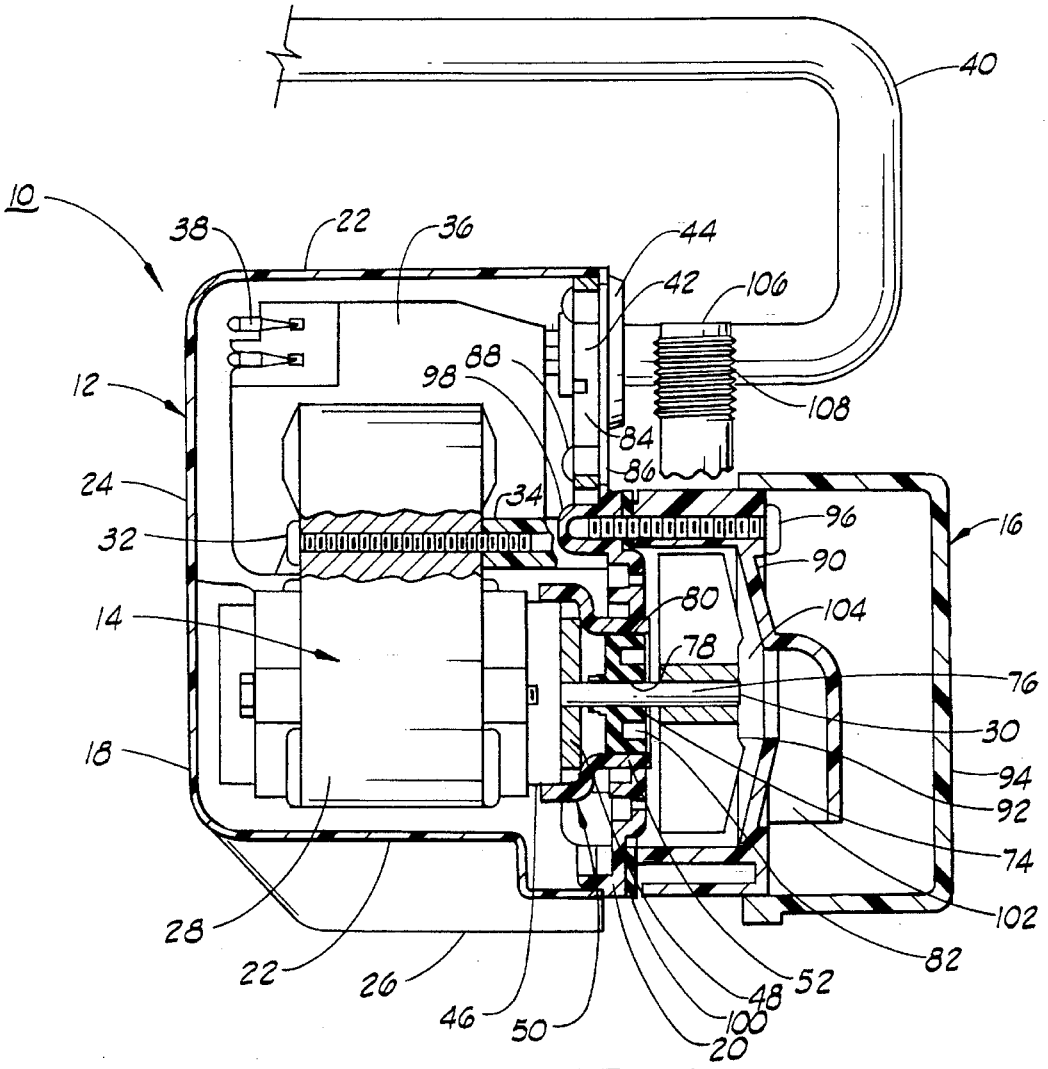
FIG. 1 is a partial cross section view of a potted pump assembly constructed in accordance with the present invention, generally taken along a section line 1—1 of FIG. 2.

Referring to the drawings in general, and to FIG. 1 specifically, shown therein is a pump assembly 10 which is constructed in accordance with the present invention. The pump assembly 10 has a housing assembly 12, a motor assembly 14, and a pumping assembly 16.

The housing assembly 12 supports the motor assembly 14 and serves as a potting case to contain the motor assembly 14, thus hermetically sealing the motor assembly 14 from the environment external to the housing assembly 12. The housing assembly 12 provides a basically hollow box shaped structure which also provides structural integrity for the pump assembly 10 as described hereinbelow.

The housing assembly 12 has two sections; a motor housing 18 and a motor mounting plate 20. The motor housing 18 is of one piece construction, forming a hollow shaped box member having one side open. The motor housing 18 is contiguously formed by side members 22 and a rear member 24. The lower side member 22 has formed therewith a plurality of leg members 26 which extend perpendicularly from the lower side member 22 to serve as support legs upon which the pump assembly 10 is supported in operation.

Continuing discussion of the housing assembly 12, the motor mounting plate 20 is made to press fit into the open end of the motor housing 18 to form therewith a closely fitting joint therebetween. As will be described hereinbelow, the joint between the motor mounting plate 20 and the motor housing 18 is encapsulated in epoxy to form a hermetically sealed potting case for protection of the motor assembly 14 from the external environment.

The motor assembly 14, contained within the housing assembly 12, has a motor 28 having a rotatable shaft 30. The motor 28 is attached to the housing assembly 12 by way of a plurality of screw members 32 (one shown) passing through the motor 28 and engaging an apertured boss 34 formed as a portion of the motor mounting plate 20. This attachment does not affect the critical positional relationship of the motor shaft to a shaft seal, as will be described hereinbelow.

The motor assembly 14 has a base 36 that supports terminals 38 connected to the windings of the motor 28 to provide convenient electrical connections to the motor 28. An electrical cord 40 is attached at its first end to the terminals 38 and provides electrical power to the motor 28 by attachment at a distal end to an electrical power source, such as a common electrical outlet.

The electrical cord 40 exits the housing assembly 12 to reach the external power source through a cord aperture 42 in the motor mounting plate 20. A grommet 44 is disposed within the cord aperture 42 to provide sealing engagement against the motor mount plate 20 and the electrical cord 40 and the joint formed is encapsulated with epoxy to ensure the sealing integrity of the housing assembly 12 as described hereinbelow.

Continuing the discussion of the motor assembly 14, the motor 28 has a cylindrical reference surface 46, and a planar reference surface 48 at one end thereof as shown. A shaft sealing and alignment assembly 50 is press fit over the cylindrical reference surface 46 and abuts the planar reference surface 48 of the motor 28 in a manner described in detail hereinbelow.

Figure 3:
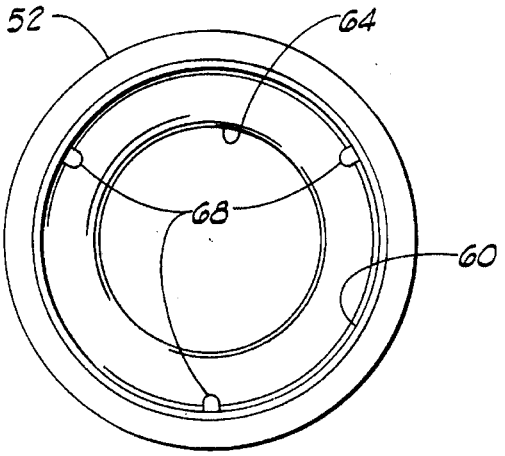
FIG. 3 is an end view of the shaft seal mount.
Figure 3A:
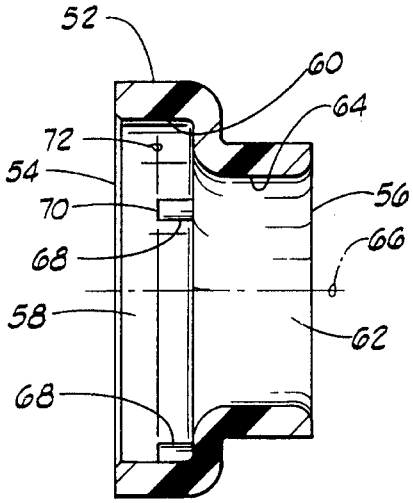
FIG. 3A is a cross sectional view thereof.

Turning to FIGS. 3 and 3A, shown therein is a portion of the shaft sealing and alignment assembly 50 which includes a shaft seal mount 52 having a first end 54 and a second end 56. The first end 54 forms a motor bore 58 and has a first end inner surface 60. The second end 56 forms a shaft seal bore 62 which has a second end inner surface 64. The motor bore 58 and the shaft seal bore 62 are concentric and have a common central axis 66.

The first end 54 of the shaft seal mount 52 contains a plurality of detents 68 molded contiguously on the first end inner surface 60. Each detent 68 has a motor stop surface 70, and the motor stop surfaces 70 are coplanar; that is the motor stop surfaces 70 collectively define a reference motor stop plane 72 which is perpendicular to the central axis 66.

Returning to FIG. 1, it will be noted that, when the shaft seal mount 52 is pressed onto the cylindrical reference surface 46, the cylindrical reference surface 46 of the motor 28 is pressingly engaged against the first end inner surface 60 of the shaft seal mount 52 such that the planar reference surface 48 of the motor 28 abuts against the motor stop surfaces 70 of the detents 68. That is, the planar reference surface 48 thereby coincides with the motor stop plane 72. Consequently, the shaft seal mount 52 is attached to the motor 28 in a manner that extends the rotatable shaft 30 through the motor bore 58 and the shaft seal bore 62 of the shaft seal mount 52 in coextensive relationship with the central axis 66.

A shaft seal 74 is disposed in the shaft seal bore 62 of the shaft seal mount 52. The shaft seal 74 has a central bore 76 through which the rotatable shaft 30 extends. The shaft seal 74 has an inner surface 78 which is configured to sealingly engage against the rotatable shaft 30, and the shaft seal 74 has an outer surface 80 which sealingly engages against the second end inner surface 64 of the shaft seal mount 52. Thus, the shaft seal 74 provides sealing integrity to the housing assembly 12 during operable rotation of the shaft 30 within the shaft seal mount 52.

The rotatable shaft 30 of the motor 28 extends through a shaft aperture 82 in the motor mounting plate 20 and connects to the pump assembly 16. The second end 56 of the shaft seal mount 52 passes slidingly through the shaft aperture 82 and the joint therebetween is encapsulated in epoxy to ensure the sealing integrity of the housing assembly 12 as described hereinbelow.

As described hereinabove, the motor assembly 14 is attached to the housing assembly 12 by screw members 32 engaging apertured bosses 34, and the second end 56 of the shaft seal mount 52 extends through the shaft aperture 82 of the motor mounting plate 20. The attachment of the motor assembly 14 to the housing assembly 12 does not affect the critical positional relationship of the shaft 30 to the shaft seal bore 62. This critical positional relationship is provided by the attachment of the shaft sealing and alignment assembly 50 to the motor assembly 14.

At this stage of assembly, the housing assembly 12 is filled with an epoxy material to provide sealing integrity to the housing assembly 12 at the joints formed by the attachment of the motor mounting plate 20 and the motor housing 18; the grommet 44 and the cord aperture 42; and the shaft seal mount 52 and the shaft aperture 82.

The epoxy material is delivered into the motor housing 18 of the housing assembly 12 through a filling aperture 84 in the motor mounting plate 20. A cover plate 86 is disposed within the filling aperture 84 once the housing assembly 12 is filled with epoxy. The cover plate 86 has prongs 88 which pressingly engage against the edges of the motor mounting plate 20 at the filling aperture 84.

The housing assembly 12 also provides supporting attachment for the pump assembly 16. The pumping assembly 16 consists of a volute 90, an impeller 92, and an intake screen 94. The volute 90 is attached to the motor mounting plate 20 by a plurality of screw members 96 (one shown) engaging indentations 98 molded therein the motor mounting plate 20. A gasket 100 is placed between the volute 90 and the motor mounting plate 20 for sealing engagement therebetween.

Figure 2:
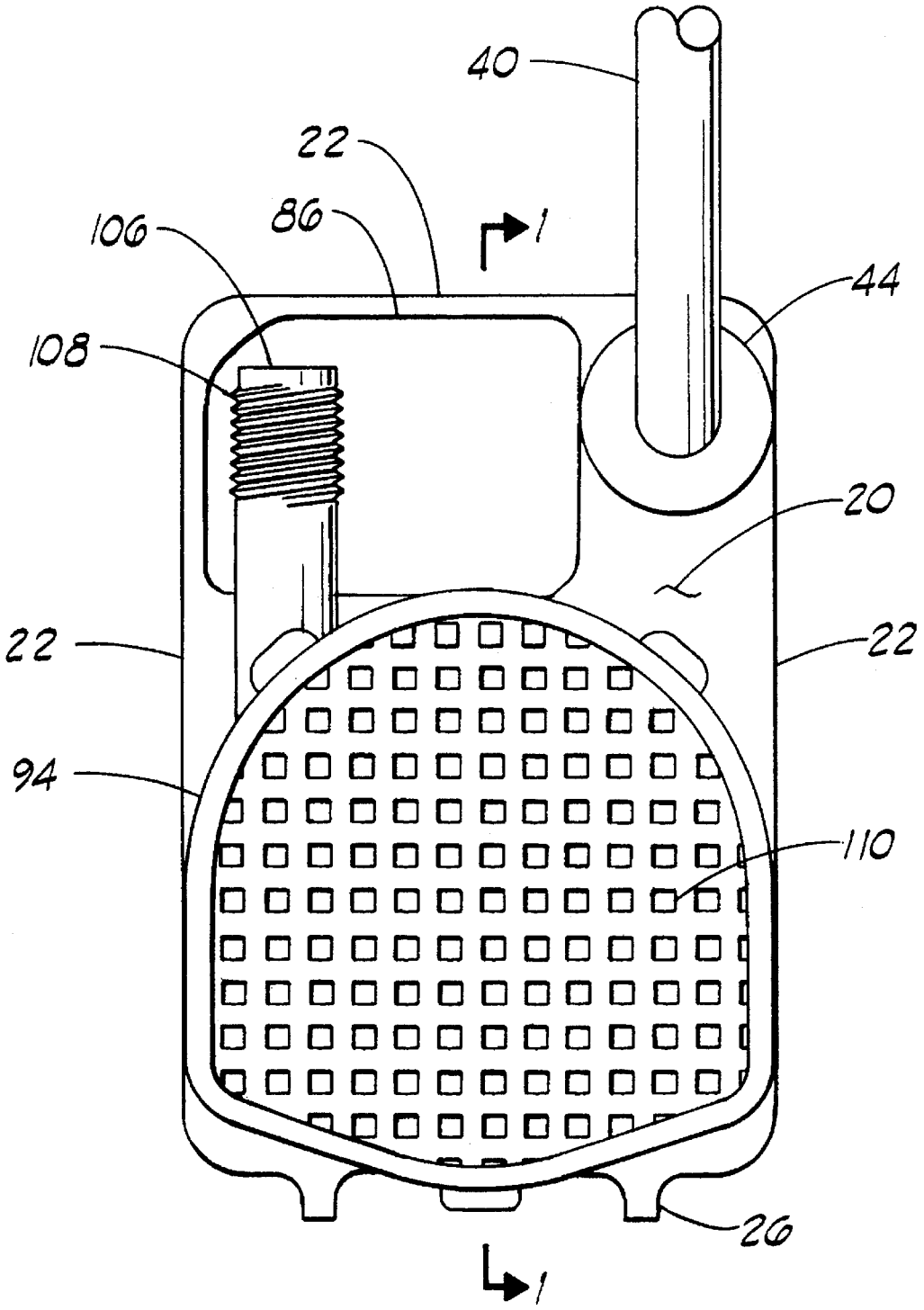
FIG. 2 is a plan view showing the motor mounting plate side of the pump.

The volute 90 contiguously forms an inlet port 102, a pump chamber 104, and an outlet port 106, all of which are in fluid communication therebetween. The impeller 92 is attached to the rotatable shaft 30 and disposed within the pump chamber 104 for operable rotation during operation of the pump assembly 10. The operable rotating impeller 92 effects pressure differentials in the fluid within the volute 90 so as to effect fluid transmission from the inlet port 102, through the pump chamber 104, and out the outlet port 106. As shown in FIG. 2, the intake screen 94 is press fit onto the volute 90 to prevent fluid borne particles from entering the pump chamber 104. The outlet port 106 terminates with a threaded portion 108 to facilitate attachment of an external conduit (not shown). The intake screen 94 has a plurality of screen apertures 110, the number and size of which are determined as required by the contamination level of the fluid being pumped and by the allowable pressure drop across the intake screen 94.

It is, therefore, apparent that the present invention is well-adapted to carry out the objects and attain the ends and advantages mentioned as well as to achieve those inherent therein. While a presently preferred embodiment of the invention has been described for purposes of this disclosure, numerous changes may be made which will readily suggest themselves to those skilled in the art and which are encompassed within the spirit of the invention disclosed and as defined in the: appended claims.

What is claimed is:

1. An improved pump assembly comprising:

a housing assembly comprising:

a motor mounting plate having a shaft aperture;

a motor housing attached to the mounting plate; and means for hermetically sealing the motor mounting plate and the motor housing;

a motor assembly disposed within the housing assembly and supported on the motor mounting plate, comprising:

a motor having a rotatable shaft extending coaxially through the shaft aperture; and a shaft sealing and alignment assembly comprising:

a shaft seal mount having a first end attached to the motor assembly and having a second end forming a shaft seal bore, the second end of the shaft seal mount extending into and sealingly disposed in the motor mounting plate about the rotatable shaft; and a shaft seal disposed within the shaft seal bore, the shaft seal sealingly engaging a distal end portion of the shaft seal mount and sealingly engaging against the rotatable shaft; and a pump supported by the motor mounting plate and operatively engaged by the rotatable shaft.

2. The pump assembly of claim 1 wherein the motor assembly has a planar abutment surface and wherein the shaft seal mount comprises:

a first end portion having a first bore and a second end portion forming the shaft seal bore, the first bore and the shaft seal bore in communication and having a common central axis therethrough; and detent means disposed in the first end portion for aligning the shaft seal mount and the motor assembly when attached thereto by abutting against the planar abutment surface of the motor assembly.

3. The pump assembly of claim 2 wherein the motor assembly has a reference surface, and wherein the shaft seal mount has a first inner surface of the first end portion of the shaft seal mount which pressingly engages the reference surface in attachment of the motor assembly to the shaft seal mount.

4. The pump assembly of claim 3 wherein the detent means comprises a plurality of detents formed on the first inner surface with each detent having a motor stop surface that abuts the planar abutment surface of the motor assembly in attachment of the motor assembly to the shaft seal mount.

5. The pump assembly of claim 4 wherein each of the detents has a motor stop planar surface, the motor stop planar surface of the detents defining a motor stop plane for abuttingly engaging the motor assembly in the first end portion of the shaft seal mount.

6. The pump assembly of claim 5 wherein the second end of the shaft seal mount has a second inner surface, and wherein the shaft seal comprises:

an outer portion having an outer surface configured to sealingly engage the second inner surface of the shaft seal mount; and an inner shaft seal portion supported by the outer portion and having a central aperture configured to receive the rotatable shaft therethrough and to sealingly engage against the rotatable shaft.

7. The pump assembly of claim 6 wherein the pump has an impeller connected to the distal end of the rotatable shaft of the motor.

8. An improved pump assembly comprising:

a motor mounting plate having a shaft aperture;

a motor housing attached to the mounting plate;

a motor having a rotatable shaft, said motor disposed within the motor housing and supported on the motor mounting plate;

means for hermetically sealing the motor mounting plate and the motor housing;

a shaft sealing and alignment assembly comprising:

a shaft seal mount having a first end attached to the motor and having a second end forming a shaft seal bore, the second end of the shaft seal mount extending into and sealingly disposed in the motor mounting plate about the rotatable shaft; and a shaft seal disposed within the shaft seal bore and sealingly engaging the rotatable shaft; and a pump supported by the motor mounting plate and operatively engaged by the rotatable shaft.

9. The pump assembly of claim 8 wherein the shaft seal mount comprises:

a first end portion having a first bore and a second end portion forming the shaft seal bore, the first bore and the shaft seal bore in communication and having a common central axis therethrough; and means disposed in the first end portion for aligning the shaft seal mount and the motor assembly when attached thereto.

10. The pump assembly of claim 9 wherein the motor has a reference surface, and wherein the first end portion of the shaft seal mount has a first inner surface pressingly engaging the reference surface.

11. The pump assembly of claim 10 wherein the aligning means comprises a plurality of detents formed on the first inner surface with each detent having a motor stop surface that abuts the motor.

12. The pump assembly of claim 11 wherein each of the detents has a motor stop planar surface defining a motor stop plane for abuttingly engaging the motor in the first end portion of the shaft seal mount.

13. The pump assembly of claim 12 wherein the second end of the shaft seal mount has a second inner surface, and wherein the shaft seal comprises:

an outer portion having an outer surface configured to sealingly engage the second inner surface of the shaft seal mount; and an inner shaft seal portion supported by the outer portion and having a central aperture configured to receive the rotatable shaft therethrough and to seal about the rotatable shaft.

14. The pump assembly of claim 13 wherein the pump has an impeller connected to the distal end of the rotatable shaft of the motor.

* * * * *